United States Patent [19]

Goodson et al.

[11] Patent Number: 5,070,705

[45] Date of Patent: Dec. 10, 1991

[54] REFRIGERATION CYCLE

[76] Inventors: David M. Goodson, 12823 N. Sparta Ave., Kent City, Mich. 49330; Ronald G. Wells, 7335 Glendora, Jenison, Mich. 49428

[21] Appl. No.: 640,350

[22] Filed: Jan. 11, 1991

[51] Int. Cl.[5] ..... F25B 39/04

[52] U.S. Cl. ..... 62/197; 62/196.4; 62/509

[58] Field of Search ..... 62/149, 174, 196.4, 62/509, 197, DIG. 17, 196.1, 117

[56] References Cited

U.S. PATENT DOCUMENTS

| | | | |
|---|---|---|---|
| 2,715,317 | 8/1955 | Rhodes | 62/149 |
| 3,238,737 | 3/1966 | Shrader et al. | 62/149 X |
| 4,012,921 | 3/1977 | Willitts et al. | 62/151 |
| 4,136,528 | 1/1979 | Vogel et al. | 62/174 |
| 4,167,102 | 9/1979 | Willitts et al. | 62/152 |
| 4,365,482 | 12/1982 | Langgard et al. | 62/149 |
| 4,430,866 | 2/1984 | Willitts | 62/509 X |
| 4,457,138 | 7/1984 | Bowman | 62/DIG. 17 |
| 4,562,700 | 1/1986 | Atsumi et al. | 62/174 |
| 4,566,288 | 1/1986 | O'Neal | 62/196.1 |
| 4,621,505 | 11/1986 | Ares et al. | 62/509 |
| 4,735,059 | 4/1988 | O'Neal | 62/196.4 |
| 4,735,060 | 4/1988 | Alsenz | 62/225 |
| 4,831,835 | 5/1989 | Beehler et al. | 62/509 |
| 4,862,702 | 9/1989 | O'Neal | 62/509 |

*Primary Examiner*—Harry B. Tanner

*Attorney, Agent, or Firm*—Lowe, Price, LeBlanc & Becker

[57] ABSTRACT

A refrigeration system is described in two preferred embodiments. In both embodiments, the refrigeration cycle includes a conventional compressor, condenser, expansion valve and evaporator. The receiver is not in the loop normally. In one embodiment, a pressure differential valve diverts subcooled refrigerant to the receiver only in response to a predetermined difference in pressure between the saturation pressure caused by the ambient surrounding the condenser, plus spring pressure and the pressure within the line leaving the condenser. Refrigerant thus diverted is metered back into the suction side of the system. In a second embodiment, compressed gas exiting the compressor is diverted to the receiver responsive to a pressure differential between saturation pressure caused by condenser ambient plus spring pressure and the pressure within the receiver. The refrigerant thus diverted raises the pressure within the receiver which in turn drives liquid refrigerant back into the liquid line.

6 Claims, 1 Drawing Sheet

REFRIGERATION CYCLE

FIELD OF THE INVENTION

This invention relates to an improvement in refrigeration, and typically in commercial refrigeration units that have the standard condenser, receiver, expansion valve, and one or more compressors.

BACKGROUND OF THE INVENTION

In commercial refrigeration units, a condenser is normally located on the roof top where heat can be exhausted to the ambient atmosphere. The output from the condenser then flows to a receiver tank where it is stored and liquid from the receiver tank then flows to expansion valves and an evaporator where cooling occurs as the refrigerant changes phase from liquid to gas. The output from the evaporator then travels by suction to one or more compressors and the output from the compressor then returns to the condenser wherein heat is extracted therefrom and the cycle is repeated.

It is desirable to maximize the subcooling in the condenser so that the refrigerant is cooled below the phase change transition temperature and that subcooling retained to a maximum extent as the liquid recirculates.

It is further desirable to minimize the amount of refrigerant charged to the system and to operate at the lowest possible discharge pressure from the condenser.

However, when the subcooled liquid from the condenser is stored in a receiver, it may be heated. Accordingly, in U.S. Pat. No. 4,831,835, it was proposed to bypass the receiver selectively based upon the output temperature of the condensed liquid from the condenser. When the liquid temperature drops below a predetermined value indicating the desired level of subcooling, the bypass is activated and the subcooled refrigerant flows from the condenser to the expansion valves. When the liquid temperature increases above the desired level, the bypass is closed and flow from the condenser to the receiver is opened. According to the first condition the receiver remains in the flow path through a pressure regulating valve even when bypassed.

SUMMARY OF THE INVENTION

It has been discovered, however, that the receiver can be effectively removed from the flow path and the subcooling maximized while minimizing the refrigerant charge by the use of dynamic regulating valves. The valves use a temperature sensor or power element which is disposed within the air stream beneath the condenser, sheltered from sun exposure to produce a signal proportional to the saturation pressure caused by the condenser ambient. A second sensor is disposed in the liquid line upstream of the valve. The valve then registers a differential pressure which in turn controls bypass flow to the receiver. This valve will hereafter be called ambient compensated pressure regulating valve. The valves, of course, are biased and the spring pressure also affects the signal in the conventional manner.

In addition, although the receiver is disposed outside the flow path, a metering device can be provided to return refrigerant therefrom to the system when necessary. In this way, when the requirement for refrigerant is at a maximum, the refrigerant in the receiver remains active within the recirculating system rather than being stored in the receiver. This amounts to a significant reduction in refrigerant charge required to satisfy the system during maximum demand.

In an alternative method, another ambient compensated pressure regulating valve is used to regulate the application of compressor discharge pressure to the receiver. This differential can then be used to drive excess liquid in the receiver back into the liquid line to maintain equilibrium of the quantity of liquid refrigerant circulating in the system.

Accordingly, it is an object of this invention to provide a refrigeration cycle wherein the receiver tank is substantially removed from the flow path depending upon the differential pressure between the liquid line and the saturation pressure based on the ambient temperature at the condenser and valve setting, (spring pressure) or similar differential pressure or temperature to drive a control valve to achieve the described purpose.

It is another object of this invention to provide a refrigeration cycle minimizing the storage of refrigerant in the receiver whereby during maximum demand, liquid from the receiver is bled into the low pressure side of the system.

It is a further object of this invention to provide a refrigeration cycle wherein efficiency is maximized and the refrigerant charge minimized based upon the differential between the saturation pressure caused by the condenser ambient plus spring pressure and the internal line pressure.

These and other objects will become readily apparent with reference to the drawings and following description wherein:

DETAILED DESCRIPTION OF THE INVENTION

Figure 1:
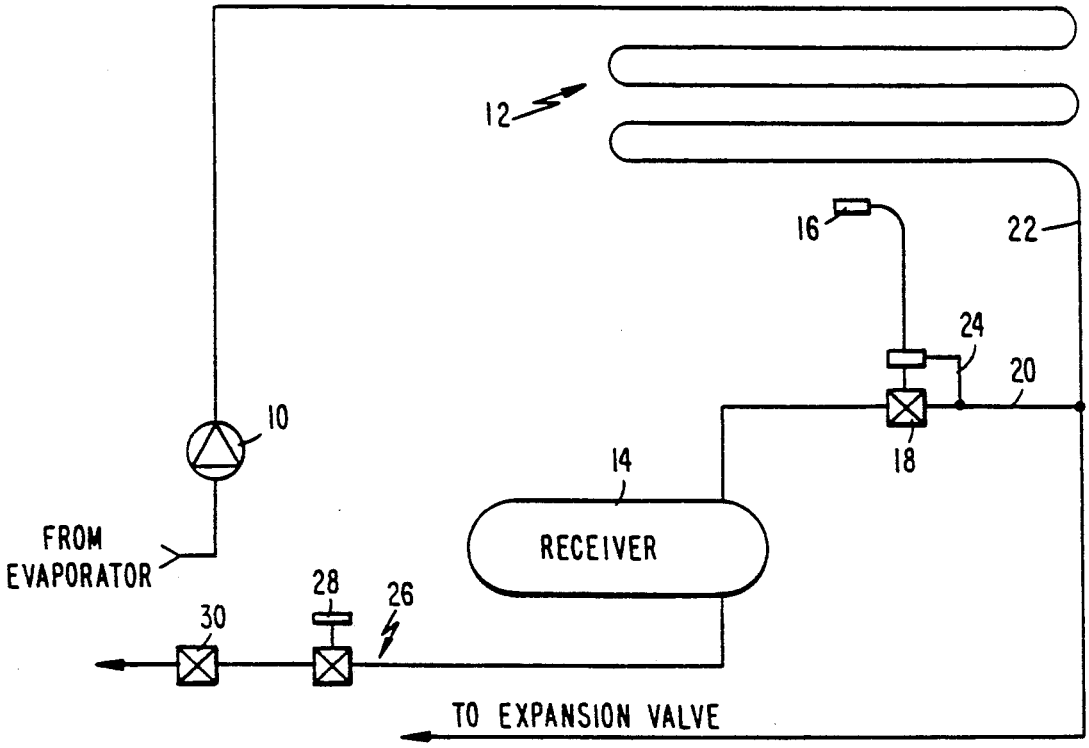
FIG. 1 is a schematic of a preferred refrigeration system of this invention.

With attention to the drawings and to FIG. 1 in particular, the basic components of the system of this invention include the conventional elements of a refrigeration cycle, i.e., a compressor 10, a condenser 12, a receiver 14 and one or more expansion valve (not shown) and an evaporator (not shown). It will be understood that the compressor 10 may be in fact one or more of such units in parallel. The invention hereinafter described is not dependent upon the number or size of the compressors and in fact they may be of unequal size.

Typically, the remote condenser 12 will be situated on a rooftop and a stream of air passing therethrough provides subcooling of the refrigerant circulating therethrough by natural ambient means. A power element or sensor 16 is provided in that air stream, sheltered from the sunlight. This sensor will reflect saturation pressure caused by the condenser ambient.

Contrary to conventional design, the receiver 14 is not in the circulation path for refrigerant circulating from the condenser 12 through expansion valves and the evaporator and compressor to return to the condenser. An ambient compensated pressure regulating valve 18 is provided in the line 20 controlling the flow from the output line 22 of the compressor to the receiver 14. Valve 18 uses a second sensor 24 upstream to measure the line pressure in line 22. Therefore, the valve 18 being an ambient compensated pressure regulating valve, compares the saturation pressure due to condenser ambient with the line pressure internal to the output from the condenser.

When the pressure in line 22 tends to rise, as in the summertime, it will tend to overcome the saturated pressure and valve 18 will begin to open. Excess refrigerant may thus be diverted to the receiver to be available to be returned to the system through bleed components 26. Bleed components 26 include a solenoid valve 28 which is operable when any compressor 10 is activated and a metering device 30 such as a capillary tube or an expansion valve. This circuit permits higher pressure liquid refrigerant from the receiver 14 to be reintroduced to the suction or low pressure side of the system.

The place of reintroduction of the refrigerant to the suction side is dependent upon several objectives. It is anticipated that compressor applications may require cooler and cooler refrigerant returned to the compressor in order to assure motor cooling of hermetic or semi-hermetic units. Even in open, direct, or belt drive units, cooler returning refrigerant may be required to resolve design compromises which come from refrigerants and refrigerating systems in order to, for example, eliminate the use of some conventional refrigerants. Therefore, in order to provide cooler return gas, the receiver bleed components through line 26 may route refrigerant to the compressor or portion thereof which requires such cooling. The amount of cooling available may be regulated by the adjustment or design of the metering device. In the alternative, a suction line manifold or an accumulator could be utilized, it being intended that the refrigerant be injected downstream of the expansion valves.

As will be obvious to those skilled in the art, the place for injecting the refrigerant will be determined by the demands placed on the individual system and it is not intended that this invention be limited to any particular place for injecting.

The ambient compensated pressure regulating valve 18 typically is a conventional design as is its sensor 16. The valve may be a mechanical valve utilizing a biased diaphragm or bellows or it may be electronic and the sensors may be electronic. The electronic system would receive sensor information which would then control an electromechanical valve also of conventional design. Accordingly, this invention is not intended to be limited to the particular type of ambient compensated pressure regulating valve, or other type of regulating valve utilized.

Figure 2:
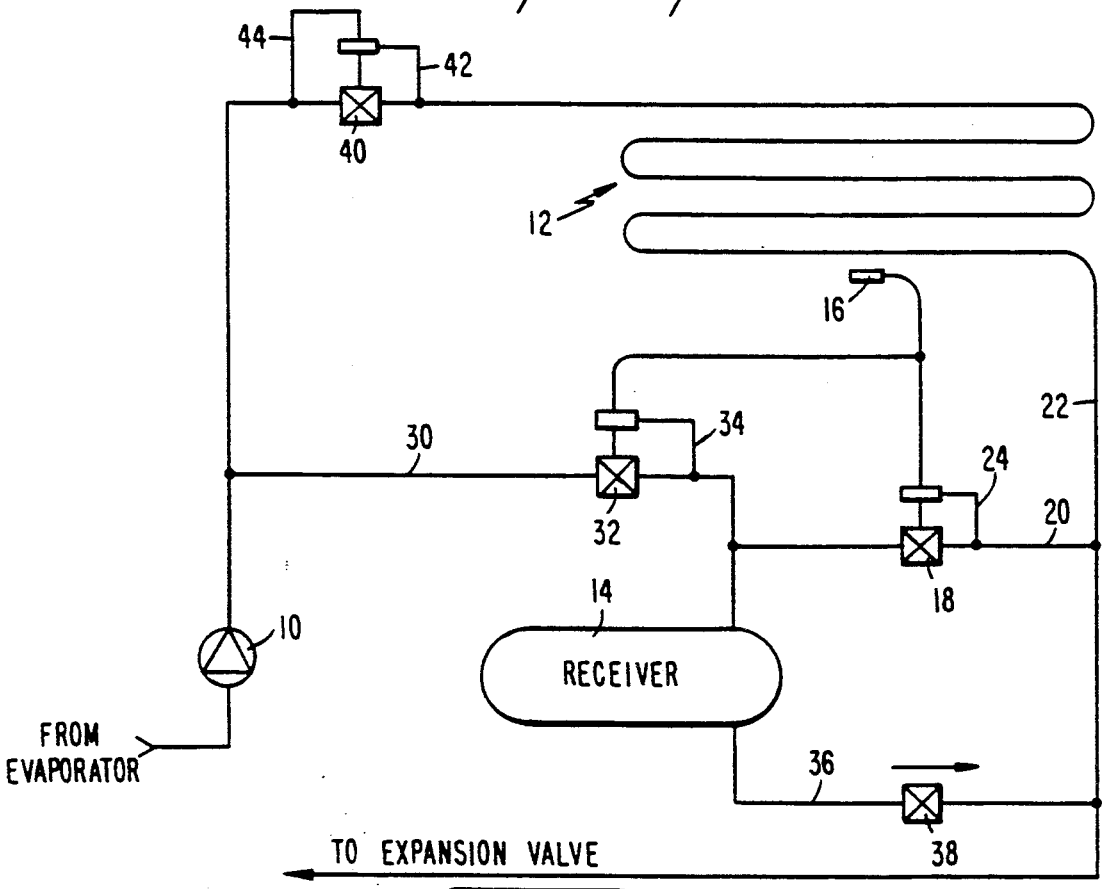
FIG. 2 is a schematic of an alternate preferred refrigeration system of this invention.

With reference to FIG. 2, there is shown a system with a different method for expelling excess liquid refrigerant from the receiver tank. During periods of low ambient temperature, the condensing pressure falls. In this instance, a line 30 is provided from the compressor 10 output. Gas through this line is controlled by an ambient compensated pressure regulating valve 32 which measures the difference in pressure between the pressure registered at sensor 16 and the receiver pressure as measured through line 34. At the differential, the output from the condenser 22 can pass through line 20 and valve 18 into the receiver along with hot gas under pressure through line 30 in valve 32. The liquid then reaches the receiver relatively warm and exits the receiver through line 36. Valve 38 is a check valve to ensure against a backward flow of liquid from line 22 into the receiver 14. If necessary, a further differential pressure valve 40 may be provided which registers the differential pressure between its sensors in lines 42 and 44 whereby it functions as a pressure reducing valve to facilitate the flow of hot gas from the compressor through line 30 to the receiver 14.

Therefore, in both embodiments, as shown in FIGS. 1 and 2, the receiver is not normally in the refrigeration cycle and is only used to store refrigerant not needed in the flow path. Only excess refrigerant is stored in the receiver, thereby reducing the charge to the system. In addition, it maximizes liquid subcooling.

The invention may be embodied in other specified forms without departing from the spirit or essential characteristics thereto. The present embodiments are therefore to be considered in all respects as illustrative and not restrictive, the scope of the invention being indicated by the appended claims rather than by the foregoing description, and all changes which may come within the meaning and range of equivalency of the claims are therefore intended to be embraced therein.

We claim:

1. In a refrigeration system for circulating refrigerant including in series a condenser, an expansion valve, an evaporator, and a compressor in a closed loop, the improvement comprising:

a receiver; and first means carried by said system for diverting refrigerant from said loop downstream of said condenser to said receiver only responsive to the difference between the saturation pressure caused by condenser ambient and the internal pressure within said loop downstream of said condenser.

2. The system of claim 1 further comprising:

means for metering a flow of refrigerant from said receiver and injecting said flow into said loop downstream of said metering device.

3. The system of claim 2 wherein said metered flow is injected any place between expansion valve and the place when compression begins within the compressor.

4. The system of claim 2 wherein said flow is injected into said loop any place that is at a lower pressure than the receiver.

5. The system of claim 1 wherein said receiver has an outlet in communication with said loop downstream of said means for diverting, said system further comprising:

second means in communication with said loop downstream of said compressor for diverting refrigerant under pressure therefrom to said receiver responsive to a difference between the saturation pressure caused by the condenser ambient and the internal pressure at said receiver; and one way conveying means responsive to said second means for conveying refrigerant from said receiver into the loop.

6. The system of claim 5 wherein said second means includes an ambient compensated differential pressure valve.

* * * * *